US005323496A

United States Patent [19]

Blair

[11] Patent Number: 5,323,496

[45] Date of Patent: Jun. 28, 1994

[54] TOILET SEAT LIFTING APPARATUS

[76] Inventor: Stephen F. Blair, 762 St. Andre Drive, Unit 7A, Gloucester, Ontario, Canada, K1C 3W4

[21] Appl. No.: 950,213

[22] Filed: Sep. 24, 1992

[51] Int. Cl.[5] ..... A47K 13/10; E03D 5/04

[52] U.S. Cl. ..... 4/246.3; 4/250

[58] Field of Search ..... 4/246.3, 250, 249, 248, 4/246.2

[56] References Cited

U.S. PATENT DOCUMENTS

| | | | |
|---|---|---|---|
| 1,999,971 | 10/1934 | Williamson | 4/251 |
| 2,251,770 | 8/1940 | Warner | 4/246.3 |
| 2,776,440 | 9/1955 | Miller | 4/251 |
| 3,303,517 | 1/1964 | Wood et al. | 4/246.4 |
| 4,426,743 | 1/1984 | Seabrooke | 4/251 |
| 4,584,724 | 4/1986 | Wilson | 4/251 |
| 4,803,741 | 2/1989 | Ellison | 4/251 |
| 4,853,983 | 8/1989 | Grant | 4/251 |
| 4,862,525 | 9/1989 | Cheng | 4/251 |
| 4,910,810 | 3/1990 | Solomon | 4/251 |
| 4,951,323 | 8/1990 | Shalom | 4/251 |
| 4,951,324 | 8/1990 | Lirette | 4/251 |

FOREIGN PATENT DOCUMENTS

| | | | |
|---|---|---|---|
| 1377147 | 9/1964 | France | 4/246.4 |
| 2171426A | 8/1986 | United Kingdom . | |

*Primary Examiner*—Henry J. Recla
*Assistant Examiner*—Gregory Vidovich

[57] ABSTRACT

A toilet seat lifting apparatus comprising two side-by-side pivotally connected flat members, a first member having two spaced holes for alignment with seat attachment holes in a rear portion of a toilet bowl, and a second member extending from the first member in a forward direction toward the front of the toilet bowl having a projection at its forward end for engagement with a toilet seat. The second member further includes a lever extending rearwardly past the first member. This assembly is operated by a foot operated actuating member mounted adjacent a side of the toilet bowl with a connection between the lever and the actuating member. Upon installation of the members beneath a toilet seat, operation of the actuating member pulls the lever down and forward, causing the second member to pivot up to lift the seat. This assembly further consists of a resilient restraint connected to a lower surface of the second member and above a top surface of the toilet bowl for restraining downward movement of the second member with respect to the top surface of a toilet bowl.

20 Claims, 5 Drawing Sheets

TOILET SEAT LIFTING APPARATUS

This invention relates to a toilet seat lifting apparatus. In particular the invention relates to such apparatus which will lift the toilet seat and a lid if present. The invention also provides for controlling the lowering of the seat. In a further feature, lowering the toilet seat can cause flushing of the toilet.

BACKGROUND OF THE INVENTION

Various reasons create a need or desire to raise a toilet seat without using hands. For example, if it is desired to empty a container into the toilet and both hands are occupied, a remote operated seat lifter is useful, and in addition avoids dirtying the seat. For hygienic reasons persons may wish to avoid touching the seat or any other part of the toilet by hand. This device allows the toilet seat to remain in the current position for women at all time, and allows hands free operation for men.

The present invention provides a toilet seat lifting apparatus which is, for example, foot operated, and will lift a seat, and a lid if present thereby allowing hands free operation of the seat. The apparatus can be fitted to existing toilets without any changes to the toilet and can be removed without impairing the toilet visually or mechanically. Once a lid has been lifted up, it would normally stay up, but the seat will return down when the actuating member is released. To prevent slamming down of the seat, the downward movement of the seat can be controlled, for example by an air bag. Also, with the device of the present invention, the seat can be retained in the lifted position, until return is required.

SUMMARY OF THE INVENTION

Broadly, in accordance with the invention there is provided a toilet seat lifting apparatus, comprising:

two side-by-side pivotally connected flat members, a first member having two spaced holes for alignment with seat attachment holes in a toilet bowl, and a second member extending forwardly of the first member and having a projection at its forward end for engagement with a toilet seat, the second member including a lever extending forwardly of the first member and having a projection at its forward end for engagement with a toilet seat, the second member including a lever extending rearward passed the first member;

a foot operated actuating member mounted adjacent the side of the toilet bowl, a connecting means extending between the actuating member and the lever, the arrangement such that on installation beneath a toilet seat, operation of the actuating member pulls the connecting means to pull the lever down and forward, the second member pivoting up and lifting the seat.

In another aspect of the present invention, there is provided a toilet seat lifting apparatus, comprising:

two side-by-side hingedly connected flat members, a first member having two spaced holes for alignment with seat attachment holes in a toilet bowl, and a second member extending forwardly of the first member and having a projection at its forward end for engagement with a toilet seat, the second member including a lever extending rearward passed the first member;

a foot operated actuating member mounted adjacent the side of the toilet bowl;

connecting means extending between the actuating member and the lever, the arrangement such that on installation beneath a toilet seat, operation of the actuating member pulls the connecting means, to pull the lever down and forward, the second member pivoting up and lifting the seat; and resilient restraining means between the second member and a top surface of the toilet.

In a further aspect of the present invention, there is provided a combined toilet seat lifting and flushing apparatus comprising:

two side-by-side hingedly connected flat members, a first member having two spaced holes for alignment with seat attachment holes in a toilet bowl, and a second member extending forwardly of the first member and having a projection at its forward end for engagement with a toilet seat, the second member including a lever extending forwardly of the first member and having a projection at its forward end for engagement with a toilet seat, the second member including a lever extending rearward past the first member;

a foot operated actuating member mounted adjacent the side of the toilet bowl, a connecting means extending between the actuating member and the lever, the arrangement such that on installation beneath a toilet seat, operation of the actuating member pulls the connecting means, to pull the lever down and forward, the second member pivoting up and lifting the seat;

a first air bag and a second air bag each having an air inlet and an air outlet, the first air bag being positioned beneath the second member, the second air bag mounted on a water tank of a toilet;

means supporting an operating arm of a flushing system on the second air bag;

a tube connecting the outlet of the first bag to the inlet of the second bag, the arrangement being such that on release of the actuating member, the first air bag is collapsed and air is fed to the second air bag to expand the second air bag and lift the operating arm to flush the toilet.

It will be understood that the apparatus does not impede manual operation, flushing being possible at any time.

The invention will be readily understood by the following description in conjunction with the accompanying drawings.

DETAILED DESCRIPTION OF THE PREFERRED EMBODIMENTS

Figure 1:
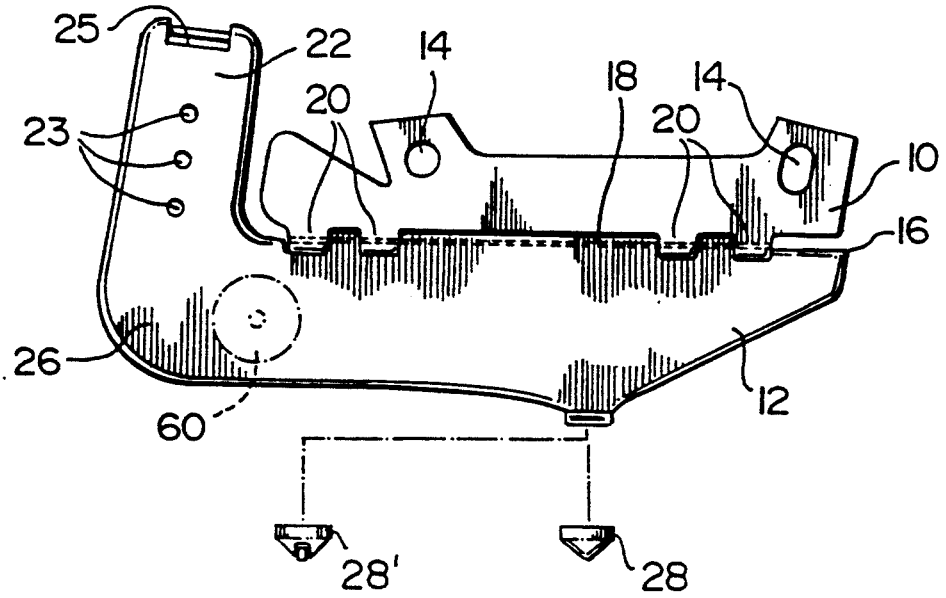
FIG. 1 is a top plan view of the pivotally connected member.

As illustrated in FIG. 1, the seat lifting portions of the apparatus consist of two flat members 10 and 12. The members 10 and 12 are elongate to fit across the back of the toilet. Member 10, in position the rear member, has two holes 14 which align with the holes in the toilet for attaching the seat, and lid if provided. Member 12, the front member, is pivotally attached at its rear edge 16 to the front edge 18 of the rear member 10 by hinge assembly 20, or by some other pivotal means, for example flexible material.

At one side, a lever or arm 22 extends rearward from the end of the front member 12, extending past the end of the rear member 10. Towards the free end of the lever are a plurality of holes 23 by which a flexible member 24 is attached to the lever at 25. Depending upon the form of the flexible member it may be attached to the bottom of the lever by various means. The holes 23 provide for adjustment of the attachment position which provides for adjustment of the lifting force.

The front edge 26 of the front member 12 has a projection 28 which is bent upwards. The projection, in the example, is approximately mid-way between the holes 14 and is positioned to contact the under surface of the rear part of a seat. In the example the projection 28 is tapered to reduce the area of contact between members 12 and the seat to a minimum. As the projection 28 is moved upwards and rearwardly a maximum leverage is realized at first, reducing during lifting, to a minimum at maximum lifting, thereby providing a controlled lifting force.

Figure 5:
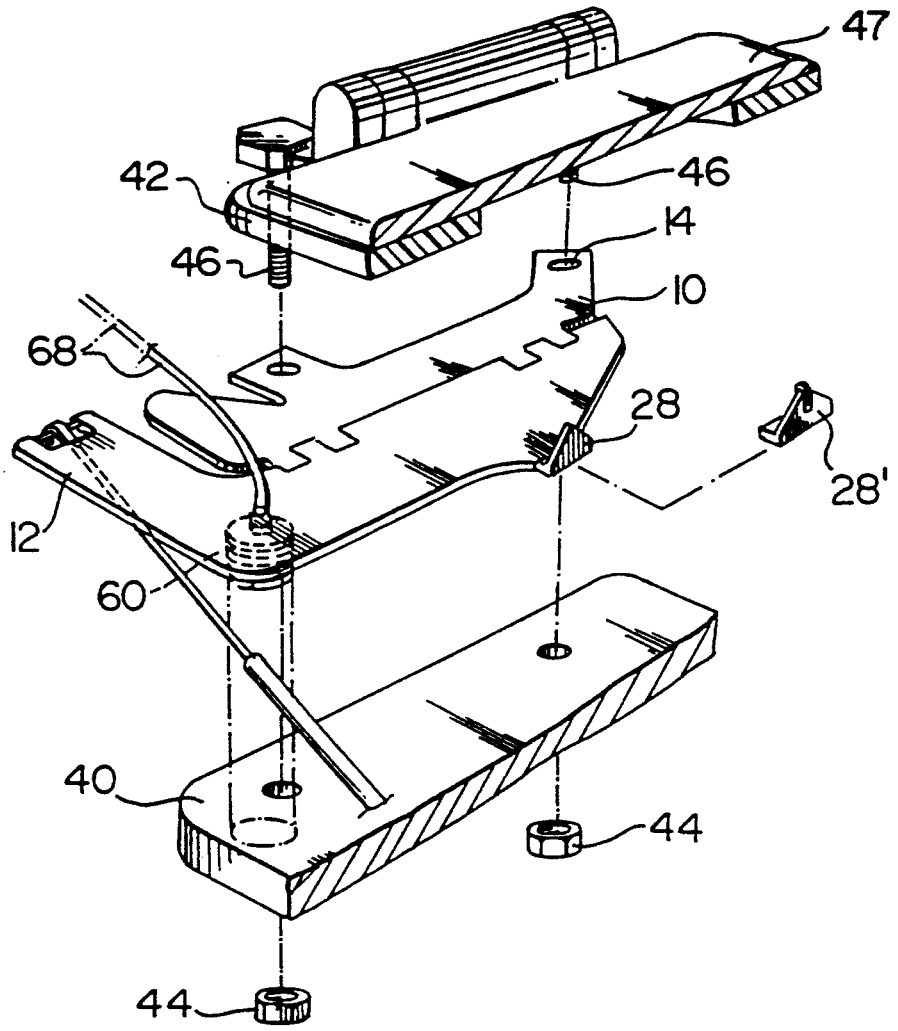
FIG. 5 is an exploded—partially cut-away view of the apparatus of the present invention.

Associated with the projection 28, there may be included a roller means such as a small wheel shown in the modified projection 28' in FIGS. 1 and 5. Other suitable roller means may include, for example, ball bearing or other low friction wear resistant material, e.g. Teflon.

Figure 3:
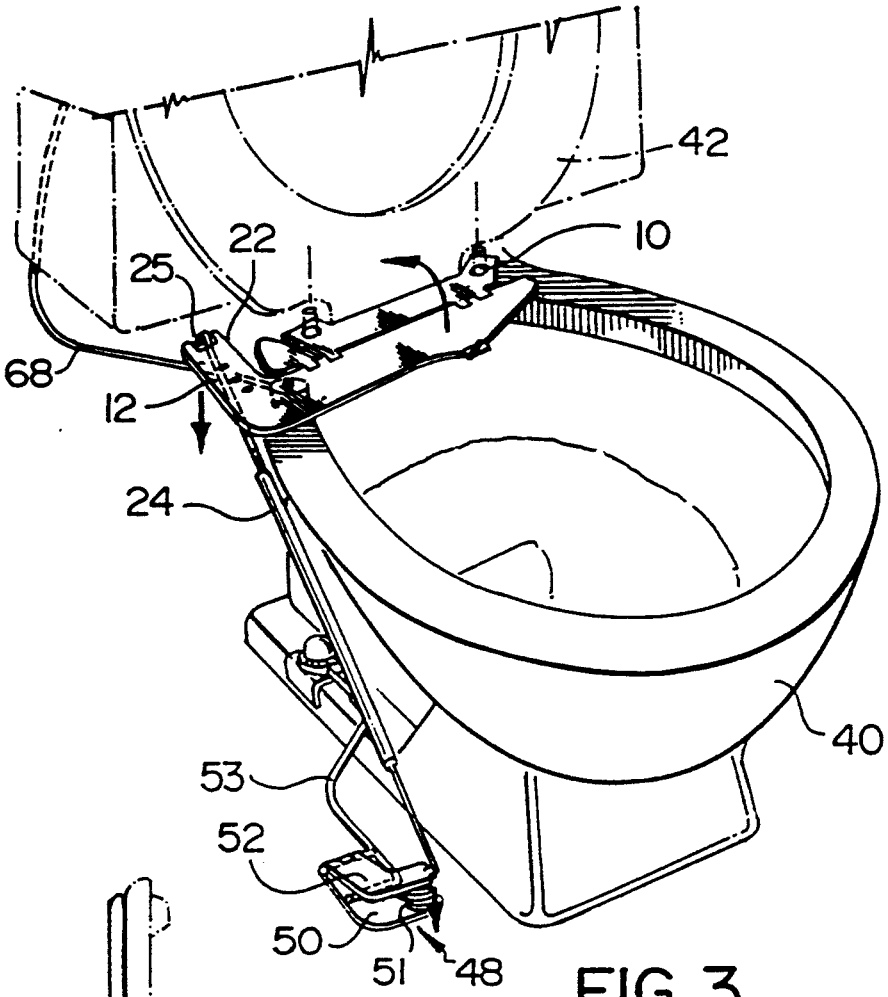
FIG. 3 is a similar view to FIG. 2 illustrating the relationship of the components when the seat is in the up position.
Figure 4:
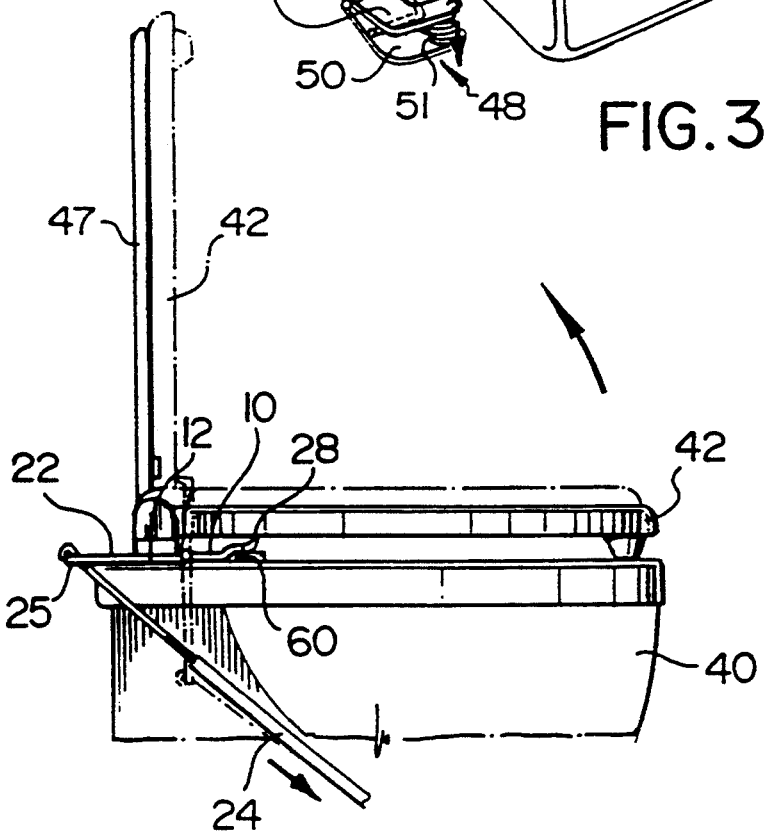
FIG. 4 is a side view of the invention applied to a toilet.

The installation of the apparatus is illustrated in FIGS. 3 and 4, shown in exploded form in FIG. 5. The flat members 10 and 12 fit on the top surface of the toilet bowl 40, under the rear of the seat 42. To fit the apparatus, the nuts 44 are removed from the bolts 46 which fasten the seat mounting parts of the seat, and lid 47, to the toilet. Seat, and lid, are removed and the flat member 10 is positioned so that holes 14 align with the holes in the toilet. The seat, and lid, are positioned on top of the members 10 and 12 and the bolts 46 reinserted, through the seat mounting assembly, and the holes 14 and through the holes in the toilet bowl structure. The nuts 44 are then reapplied to the bolts, and tightened.

A foot operated actuating member 48 is positioned on the floor and mounted adjacent the side of the toilet. The mounting of the actuating member 48 is achieved via a connecting member, shown in the example as a mounting bar 53; the latter is connected to actuation member 48 and the floor fittings of the toilet.

The actuating member, in the example, has a base member 50 and a hinged member 52 which is pivotally attached at its rear to the rear of the base member. The hinged member is resiliently biased to an upward position by spring 51. Spring 51 is used to facilitate return of member 52. The member 24 extends from the front of the hinged member, to the lever 22. Downward pressure on the hinged member 52 pulls lever 22 down and forward which in turn pivots up member 12, which in turn lifts the seat, and the lid if present. Other arrangements of the actuating member may be provided, providing the described motion on the lever 22. One such arrangement is with the hinged member 52 being hinged at a forward end to the base member discussed hereinafter.

During lifting at the seat, the contact point of the projection 28 on the seat moves towards the hinge assembly as the seat lifts. This provides control of the lifting leverage. Further control of the lifting leverage is obtainable by the provision of the apertures 23 associated with arm 22 as stated briefly herein previously. Due to the spaced positioning of the apertures 23, the amount of pressure on foot actuating member 48 may be varied to facilitate easy use by children.

Figure 2:
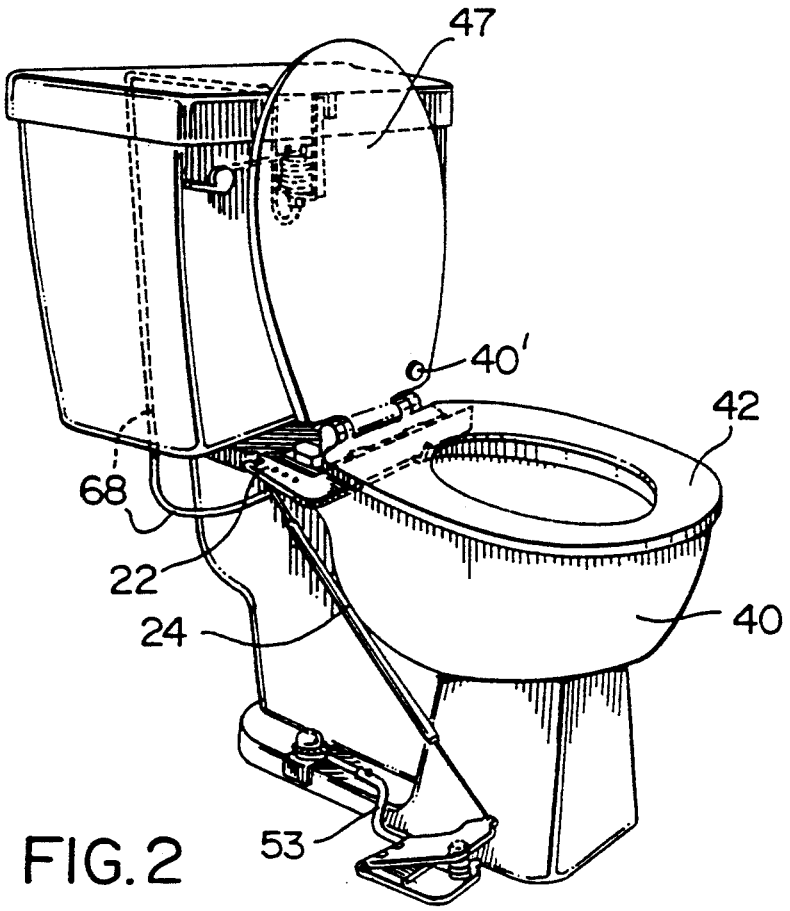
FIG. 2 is a perspective view of the apparatus as positioned on the toilet.

Depending upon the amount of movement provided for the hinged member 52, and the lever arm provided by the attachment position of the member 24 to the lever 22 a desired degree of pivoting up of the member 12 can be provided. Sufficient lifting can be provided that the seat will be lifted up to an angle slightly less than vertical. This will ensure that the seat will return down when the hinged member 22 is released. If a seat cover is fitted to the lid of the seat, this will assist in ensuring the seat returns, as seat covers generally prevent a seat from staying up. The lid, if present, can go up to the vertical and stay up, and includes a small stopper 40' as illustrated in FIG. 2. This feature restricts the movement of the seat 42 to a maximum angle of 89° to thereby facilitate return of seat 42 without lid 47.

To prevent the seat returning too quickly, a resilient restraining device can be provided, for example an air bag. An air bag will be fitted between member 12 and the top surface of the toilet, for example where indicated at 60 in FIG. 4. The air bag would be attached at a top surface to the under surface of member 12. As the seat lifts up air would be drawn in through an inlet fairly freely, but flow out would be restricted to give a controlled fall to the seat, and return of the member 12. In addition, some form of control can also be provided in the actuating member 48 to restrict the speed at which the seat is lowered, so as to transfer the weight of the seat onto the air bag at a controlled rate. This can also act to prevent too rapid a return of the seat.

Further, as an optional feature, the air bag may include therein replaceable air freshener 60' such as those of the semi-solid evaporating type.

In this way, as the seat is lowered and the air bag deflated, a pleasant aroma can be simultaneously discharged therefrom. Replacement of the freshener may be effected by temporarily removing nipple 66 or inlet 64, inserting the freshener and reinserting the former.

An alternative arrangement to the air bag would be a piece of flexible material which provides increasing resistance to deformation as it is deformed by lowering of the seat.

Figure 6:
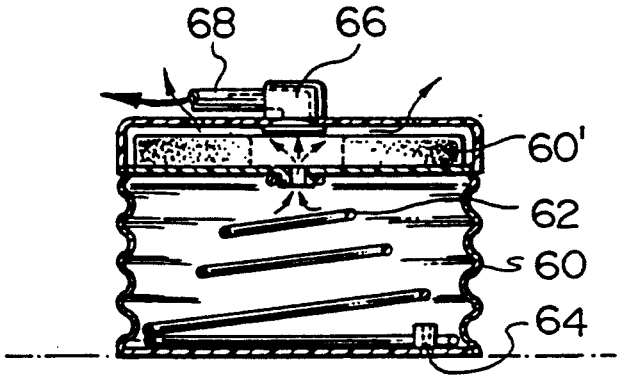
FIG. 6 is a side view of an air bag as attached beneath the pivotal member.
Figure 7:
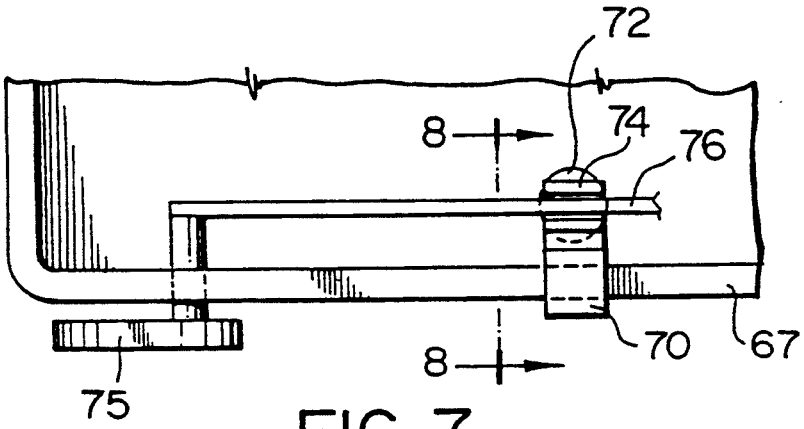
FIG. 7 is a partial top view of the tank of a toilet illustrated in the application of a modification.
Figure 8:
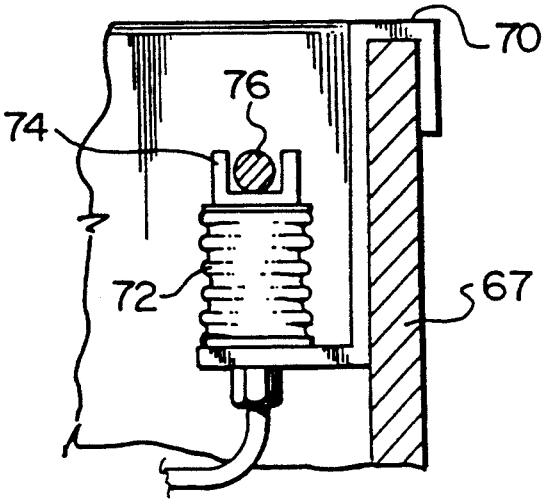
FIG. 8 is a side view of a support bracket, on line 8-8 of FIG. 7 to a larger scale.

FIGS. 7 and 8 illustrate an arrangement in which return of the seat flushes the toilet. In FIGS. 4 and 5 an air bag 60 is shown. A form of air bag, in extended condition is illustrated in FIG. 6. It is composed of a flexible pleated bag having a light spring 62 which tends to expand the bag. An inlet is indicated at 64. This can be a one-way ball valve. At the top is a nipple 66 to which is connected one end of a flexible tube 68. The tube is drawn, up the side of the tank 67 of the toilet, as illustrated in FIGS. 2 and 3. The tube is then fed into the inside of the toilet tank. A bracket 70 mounted on the inside of the tank carries an air bag 72. The bag has a light spring biasing the bag to a contracted condition.

The bag is shown extended in FIG. 8. The air bag carries a channel member 74 which engages the arm 76 actuated by handle 75 to flush the toilet. On return of the seat, bag 60 is collapsed, the air flowing through the tube 68 to the air bag 72. This lifts the arm 76 and flushes the toilet. A bleed from the bag 72 permits contraction of the bag and return of the arm after flushing. The bracket 70 is held in place on the tank wall by the toilet tank lid. The toilet can still be flushed manually by using the handle 75.

Figure 9:
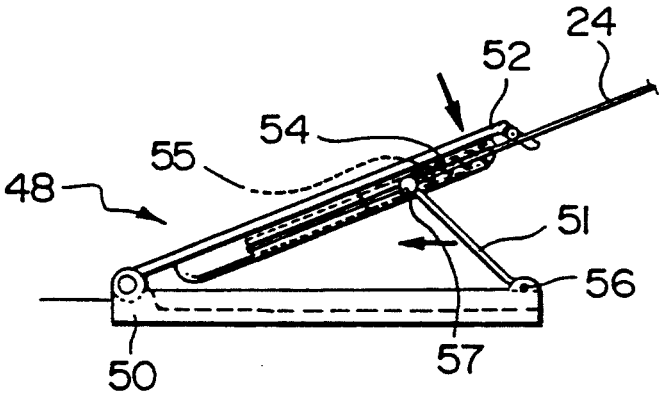
FIG. 9 is a side view of an alternate embodiment of the foot actuating member employed in the present invention.
Figure 10:
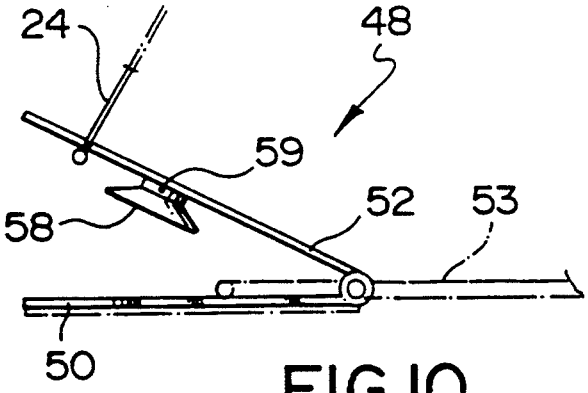
FIG. 10 is a further embodiment of the foot actuating member.

FIGS. 9 and 10 illustrate two further embodiments for the foot operated actuating member 48 bearing similar numerals for similar components of the initially described embodiment. In FIG. 9, flexible member 24 has one end fixedly secured within a hollow housing 54 situated beneath the undersurface of hinged member 52. A spring 55 is disposed within housing 54. A resiliently compliant member 51' replaces spring 51, illustrated in the previous embodiment, the former being mounted at one end 56 to base 50, while a second end 57 remains free for sliding motion within hollow housing 54. The compliant member 51' may comprise a length of thick, flexible plastic, a bar of flexible metal etc. In the Figure, the actuating member 48 is shown in a relaxed position. When the seat and/or lid is to be lifted, a downward force on member 52, as illustrated by the directional arrow, results in member 51' moving rearwardly as illustrated by the second arrow. The downward force on member 52 creates the concomitant tension in member 24 and accordingly the seat/lid lifting is achieved.

Flexible member 24, in the absence of connection within housing 54, may be connected to free end 57 of member 51'.

Turning to FIG. 10, the undersurface of hinged member 52 includes a suction cup 58 adapted for releasable contact with base 50. Flexible member 24 is connected directly to member 52 in spaced relation to suction cup 58. Downward pressure on member 52 advances suction cup 58 onto base 50 and for temporary locking therewith and accordingly, results in the seat/lid being lifted. An aperture 59 is provided on suction cup 58 to permit progressive air influx thus breaking the seal of the suction cup 58 to thereby permit the seat/lid to gradually return to a down position.

The device can be reversibly mounted on either side of the toilet, depending upon toilet installation and other features, with the appropriate variation in 28 and foot actuating member 48.

An accompanying feature of the mounting versatility resides in the fact that the aesthetics of the bathroom are unaffected by the presence of the device.

Although embodiments of the invention have been described above, it is not limited thereto and it will be apparent to those skilled in the art that numerous modifications form part of the present invention insofar as they do not depart from the spirit, nature and scope for the claimed and described invention.

I claim:

1. A toilet seat lifting apparatus, comprising:

two side-by-side pivotally connected flat members, a first of said flat member having two spaced holes for alignment with seat attachment holes in a rear portion of a toilet bowl, and a second of said flat members extending from said first member in a forward direction towards the front of the toilet bowl, said second member having a projection at its forward end for engagement with a lower surface of a toilet seat, said second member including a lever extending rearward past said first member;

a foot operated actuating member adapted to be mounted adjacent a side of the toilet bowl, a connecting means extending between said actuating member and said lever, the arrangement such that on installation of the members beneath a toilet seat, operation of said actuating member pulls said connecting means to pull said lever down and forward, thereby causing said second member to pivot up to lift the seat.

2. Apparatus as claimed in claim 1, said second member having a front edge, said projection comprising an upwardly directed projection at said front edge, to contact a lower surface of said seat.

3. Apparatus as claimed in claim 2, wherein said projection contacts said lower surface of said seat on a minimum of area thereof.

4. Apparatus as claimed in claim 2, said upwardly directed projection positioned approximately mid-way between said holes.

5. Apparatus as claimed in claim 2, wherein said projection includes a low friction surface.

6. Apparatus as claimed in claim 5, wherein said low friction surface comprises roller means.

7. Apparatus as claimed in claim 1, wherein said connecting means comprises a flexible member.

8. Apparatus as claimed in claim 7, wherein said flexible member comprises a cord.

9. Apparatus as claimed in claim 1, including resilient, restraining means connected to a lower surface of said second member above a top surface of said toilet bowl for restraining downward movement of said second member with respect to said top surface of said toilet bowl.

10. Apparatus as claimed in claim 1, including a normally expanded air bag positioned beneath said second member and attached at an upper end thereof, to the member, an inlet to said bag for entry of air to the bag, an outlet from said bag for flow of air from said bag, the arrangement being such that on operation of said actuating member to pivot said second member upwardly, said bag is expanded, and wherein deflation of said bag controlling the return of said seat.

11. Apparatus as claimed in claim 10, wherein said air bag includes an air freshener associated therewith.

12. A toilet seat lifting apparatus, comprising:

two side-by-side hingedly connected flat members, a first of said flat members having two spaced holes for alignment with seat attachment holes in a rear portion of a toilet bowl, and a second of said flat members extending from said first member in a forward direction towards the front of the toilet bowl, said second member having a projection at its forward end for engagement with a lower surface of a toilet seat, said second member including a lever extending rearward past said first member;

a foot operated actuating member adapted to be mounted adjacent a side of the toilet bowl;

connecting means extending between said actuating member and said lever, the arrangement such that on installation of the members beneath a toilet seat, operation of said actuating member pulls said connecting means, to pull said lever down and forward thereby causing said second member to pivot up to lift the seat; and resilient restraining means connected to a lower surface of said second member above a top surface of said toilet bowl for restraining downward movement of said second member with respect to said top surface of said toilet bowl.

13. Apparatus as claimed in claim 12, wherein said restraining means comprises at least one air bag.

14. Apparatus as claimed in claim 13, wherein said air bag includes an air freshener.

15. Apparatus as claimed in claim 12, wherein said projection includes a low friction surface.

16. Apparatus as claimed in claim 15, wherein said low friction surface comprises roller means.

17. A combined toilet seat lifting and flushing apparatus comprising:

two side-by-side hingedly connected flat members, a first of said flat members having two spaced holes for alignment with seat attachment holes in a rear portion of a toilet bowl and a second of said flat members extending from said first member in a forward direction towards the front of the toilet bowl, said second member having a projection at its forward end for engagement with a lower surface of a toilet seat, said second member including a lever extending rearward past said first member;

a foot operated actuating member adapted to be mounted adjacent a side of the toilet bowl, a connecting means extending between said actuating member and said lever, the arrangement such that on installation of the members beneath a toilet seat, operation of said actuating member pulls said connecting means to pull said lever down and forward, thereby causing said second member to pivot up to lift the seat;

a first air bag and a second air bag each having an air inlet and an air outlet, said first air bag connected to a lower surface of said second member above a top surface of said toilet bowl for restraining downward movement of said second member with respect to said top surface of said toilet bowl, said second air bag mounted on a water tank of a toilet;

means supporting an operating arm of a flushing system on said second air bag;

a tube connecting said outlet of said first bag to said inlet of said second bag, the arrangement being such that on release of said actuating member, said second member pivots forward and downward with respect to said toilet seat, thereby causing said first air bag to collapse and feed air residing in said first air bag to said second air bag to expand said second air bag and lift said operating arm to flush said toilet.

18. Apparatus as claimed in claim 17, wherein said second air bag is mounted to a bracket on said tank.

19. Apparatus as claimed in claim 18, wherein said second air bag carries a channel member for engaging said operating arm.

20. Apparatus as claimed in claim 17, wherein said projection contacts said lower surface of said seat on a minimum of area thereof.

* * * * *